United States Patent [19]

Cunningham et al.

[11] 4,215,762

[45] Aug. 5, 1980

[54] ACOUSTICAL ENCLOSURE

[76] Inventors: Donald R. Cunningham, 324 Center Grove Rd., Randolph, N.J. 07801; James E. Sulewsky, 7 Drake Rd., Mendham, N.J. 07945

[21] Appl. No.: 42,238

[22] Filed: May 24, 1979

[51] Int. Cl.[3] ..... B41J 29/08

[52] U.S. Cl. ..... 181/201

[58] Field of Search ..... 181/200–202, 181/204, 207, 208; 217/13, 57–59; 220/4 B, 4 C, 4 D, 4 R, 8, 253, 254; 312/107, 109, 208

[56] References Cited

U.S. PATENT DOCUMENTS

| | | | |
|---|---|---|---|
| 197,833 | 12/1877 | Deming . | |
| 1,749,177 | 3/1930 | Baxter et al. . | |
| 1,910,981 | 5/1933 | Bescherer | 181/201 |
| 2,701,618 | 2/1955 | Montgomery | 181/201 |
| 3,087,578 | 4/1963 | Reed et al. | 181/201 |
| 3,476,210 | 11/1969 | Carlson | 181/201 |
| 3,874,023 | 4/1975 | Tschudy | 181/207 |
| 3,930,559 | 1/1976 | Frick | 181/201 |

*Primary Examiner*—John Gonzales
*Assistant Examiner*—Benjamin R. Fuller
*Attorney, Agent, or Firm*—Fleit & Jacobson

[57] ABSTRACT

An acoustical enclosure for isolating high-frequency noise produced by automatic business machines, such as typewriters and teletypes. A top paper-feed housing is removable and a midsection is hinged to permit access to the enclosed machine. An exhaust fan removes heated air from the enclosure and an air-intake lip at the front of the enclosure permits ambient-temperature air to be taken into the enclosure.

10 Claims, 6 Drawing Figures

ACOUSTICAL ENCLOSURE

BACKGROUND OF THE INVENTION

The present invention relates to an enclosure having the ability to contain acoustical noise and, more specifically, to an enclosure for use with automatic business or typing machines, which isolates the high-frequency noise created by such machines.

Ever since business machines, such as typewriters and teletype machines and the like, have been introduced into the office environment attempts have been made at quieting these machines to reduce their intrusion into the office environment. Covers and cases have been devised with hinged tops and glass windows so that the office machine may be manipulated and viewed, while at the same time attempting to muffle the noise. Some cases have even been provided with ventilation fans so that the machine may operate without overheating.

Even though such cases and covers have been available for many years, at the present time there are no acoustical enclosures on the market which adequately isolate high-frequency noise. One of the reasons for this is that due to the advent of the modern high-speed printers and typewriters, the noises being produced are of a higher frequency than the old teletype or manual typewriter noise. Conventional enclosures are not sufficiently by designed so as to be capable of eliminating these undesired high-frequency noises. Additionally, the high-speed machinery of today produces mechanical vibrations, which also tend to interfere with the isolation efficiency of the acoustic enclosures.

SUMMARY OF THE INVENTION

The present invention provides an acoustical enclosure for use with electric business machines, such as typewriters and the like, which effectively isolates all high-frequency noise created by the machines. The acoustical enclosure permits full automatic operation of the machine, while being completely enclosed within the cabinet by providing an exhaust fan to remove the heated air in the interior of the enclosure. A removable paper-feed housing forms the top of the acoustical enclosure and this housing may be totally removed to gain access to the paper-feed mechanism of the machine. The midsection of the inventive acoustical enclosure is provided with a hinge at the rear so that this portion of the acoustical enclosure may also be lifted and access gained to the enclosed machine. A specialized double-gasketing system is provided at all joints between the respective portions of the acoustical enclosure.

The enclosure rests on specialized vibration isolating mounting feet, which serve to isolate all mechanical vibrations, as well as acoustic vibrations, from the office environment.

Therefore, it is an object of the present invention to provide an acoustical enclosure for use with business machines which effectively eliminates all unwanted high-frequency acoustical noise.

It is another object of the present invention to provide an acoustical enclosure for use with an office machine, which provides easy access to the machine during its operation.

It is still another object of the present invention to provide an acoustical enclosure for a business machine, which completely encloses the machine, and includes a ventilation fan for removing heated air from the enclosure.

It is a further object of the present invention to provide an acoustical enclosure which has lift-off paper-feed housing for gaining access to the business machine.

It is still a further object of the present invention to provide an acoustical enclosure formed of discrete parts and having double-gasketing at each interface between the parts.

The manner in which these and other objects are accomplished by the present invention will become evident from the following detailed description.

DETAILED DESCRIPTION OF THE INVENTION

Figure 1:
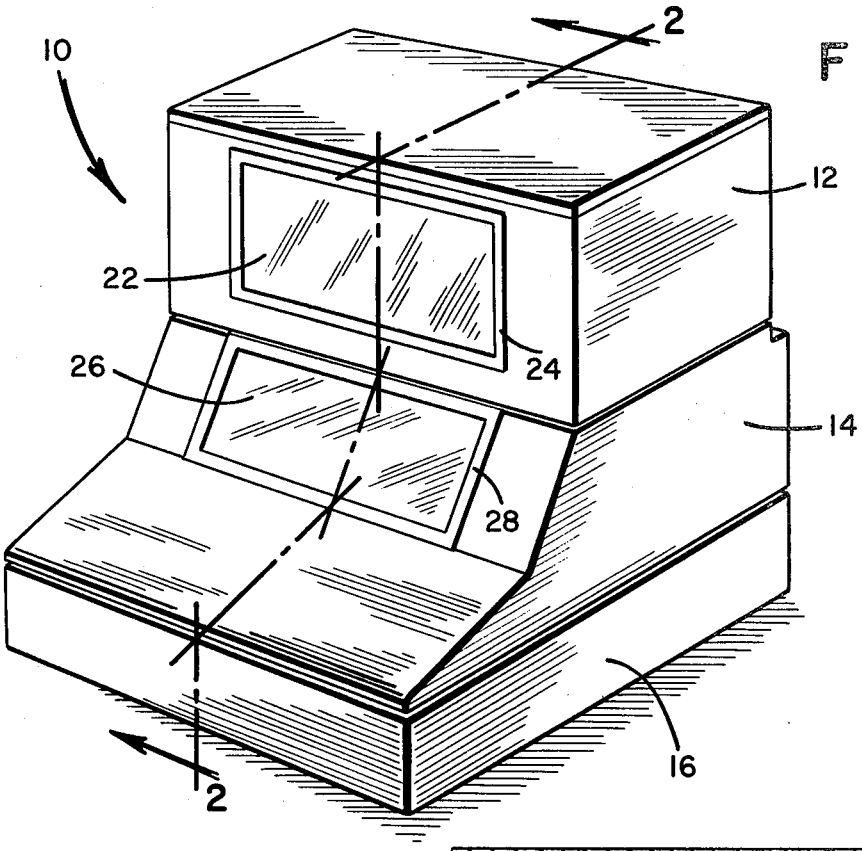
FIG. 1 is a front perspective of the inventive acoustical enclosure.

FIG. 1 is a perspective of the inventive acoustical enclosure 10. The enclosure consists of a removable paper-feed housing 12, a hinged midsection 14 and a base portion 16. The base portion 16 is provided with four vibration isolating mounting feet, which are attached to bottom panel 17 of the base portion 16. Two of the feet are seen at 18 and 20. The vibration isolating feet, 18 and 20 serve to reduce and effectively eliminate mechanical vibration produced by the business machine from being transmitted to the environment adjacent the enclosure. A clear plastic window 22 is provided in the paper-feed housing and the clear plastic is encompassed with a rubber tape 24, or the like, to form a perfect seal between the housing 12 and the window 22. In the midsection 14, a second clear plastic window 26 is provided. This window 26 is also mounted with rubber tape in the midsection 14. As will be seen hereinbelow, the midsection 14 is attached to the base section 16 by a piano-type hinge and is provided with a specialized double-gasketing system to seal in all noise and acoustic vibrations.

Figure 2:
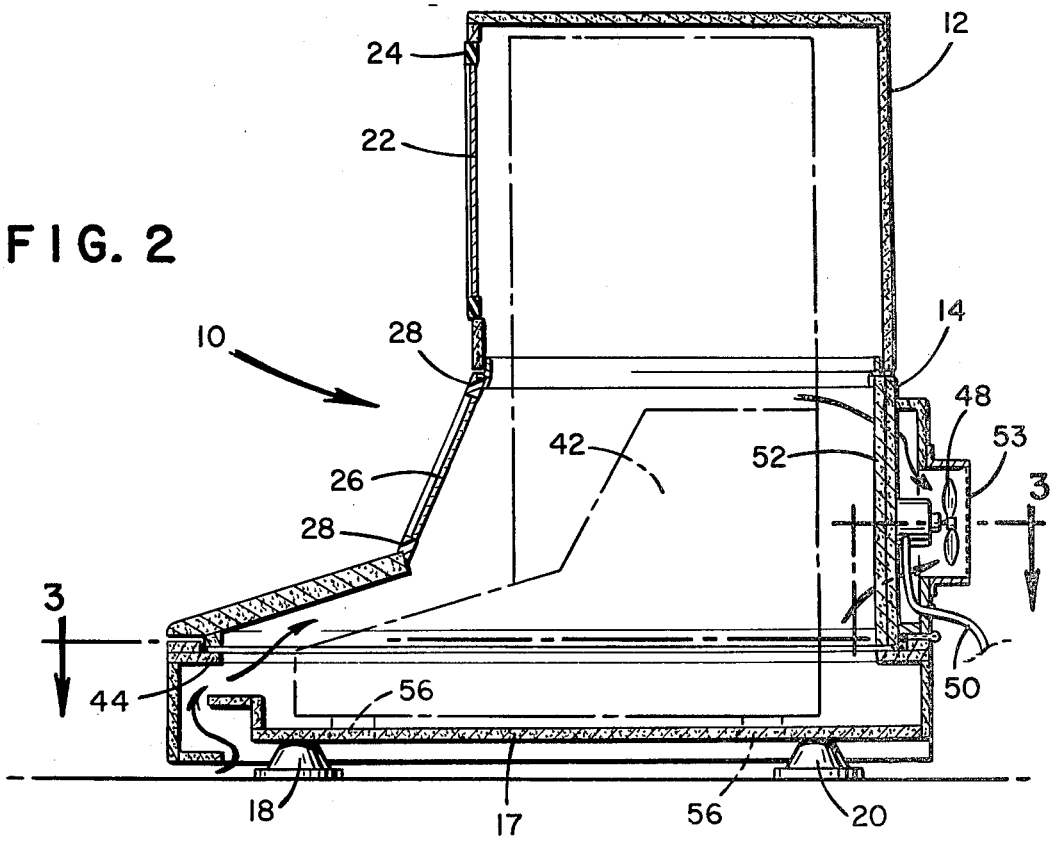
FIG. 2 is a cross-sectional view of the enclosure of FIG. 1 taken along line 2—2.

FIG. 2 is a cross-sectional view of the acoustical enclosure of FIG. 1 taken along line 2—2. The paper-feed housing 12 rests on a rim 40 which surrounds the top edge of the midsection 14. At this location a specialized dual-gasketing system is provided, which will be shown in more detail below. The typical automatic business-machine unit for use with the inventive acoustical enclosure 10, is shown in phantom at 42. The midsection 14 rests on a ledge 44 formed on the top edge of the base 16 and the double-gasketing arrangement is also provided at this location. The midsection 14 is hingedly attached to the base 16 by means of a piano hinge 46, or the like, which extends the entire width of the unit 10.

The ventilation fan is provided in the back portion of the midsection 14 and is shown diagrammatically at 48.

The fan 48 has the appropriate electrical cord 50. The fan is arranged in the rear portion of the midsection 14 and is provided with a front baffle plate 52 which is arranged at the front of the fan and in such a manner so as to prevent a strong outward flow of air across the paper in the business machine, which would otherwise disturb the paper. A louvered panel or grillwork 53 is provided at the exhaust end of the fan 48 to permit the heated air to be exhausted from the interior of the acoustical housing.

The vibration-isolating feet are mounted on the bottom of the base portion 16. The base portion is formed having a specialized lip section at the front of the base, shown typically at 44. This lip section permits ambient-temperature air to enter the acoustical enclosure 10 and to be ultimately exhausted by the fan 48.

All of the main portions of the inventive acoustical enclosure namely the paper-feed housing 12 and sections, 14, and 16, are formed of specialized half-inch thick dual-density fiberglass board having a dimpled-face, which provides both structural strength and light weight, while being an excellent acoustical damping medium.

Because the top paper-feed housing 12 rests on the rim 40 of the midsection 14, the paper-feed housing 12 may be formed in various configurations to accomodate the paper-feeding requirements of different machines 42.

Figure 3:
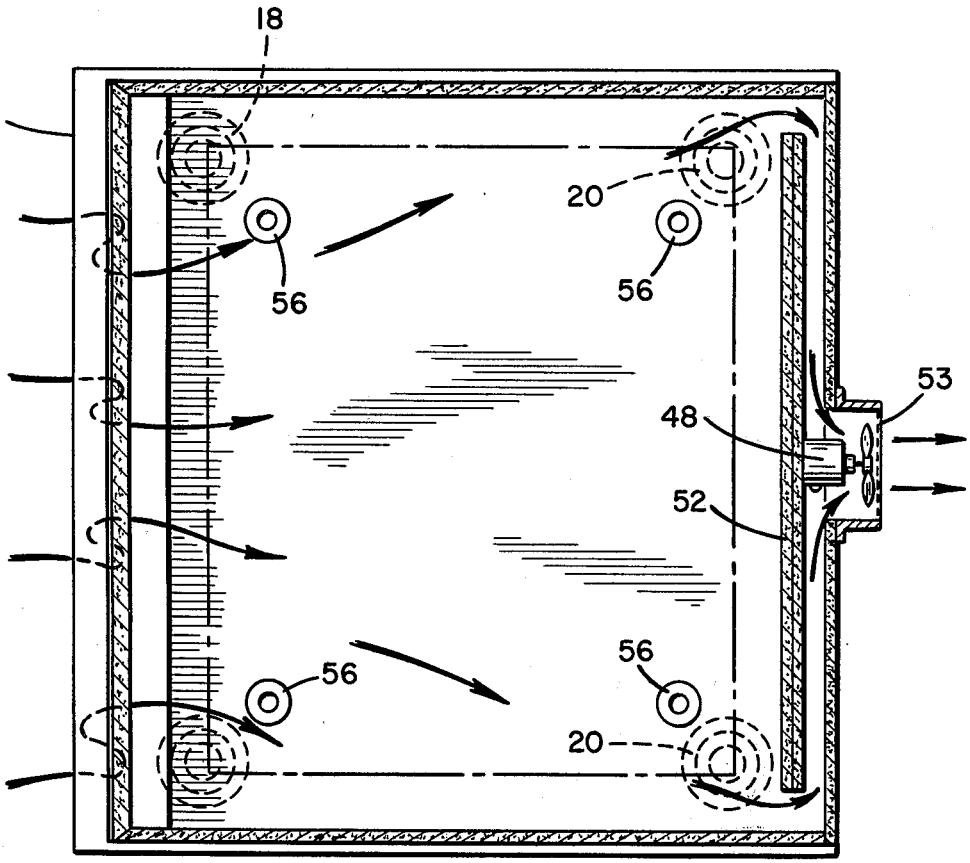
FIG. 3 is a cross-sectional view of the enclosure of FIG. 2 taken along line 3—3.

FIG. 3 is a cross-sectional view showing the interior of the inventive acoustical enclosure. More specifically, the front baffle plate 52 is shown in relation to the fan 48. This figure shows more clearly the manner in which the fan 48 and baffle plate 52 are arranged in the enclosure.

Figure 4:
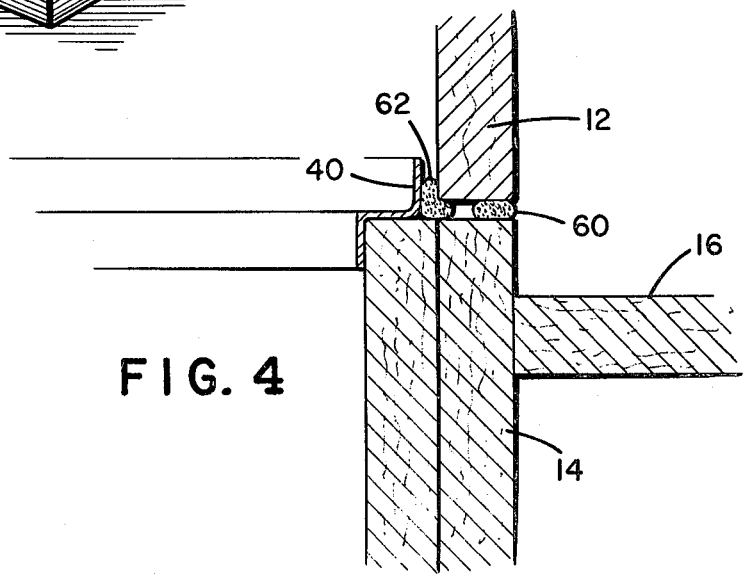
FIG. 4 is a cross-sectional detail of a portion of the inventive acoustical enclosure showing the double gasketing.

FIG. 4 is a cross-sectional detail showing the manner in which the paper-feed housing 12 fits down on the rim 40 at the top edge of the midsection 14. As may be seen, the the top section 12 sits on individual gaskets 60 and 62. These gaskets are formed of round rubber gasket material of approximately 3/16 inch in diameter. When the housing 12 is fitted down on top of these gaskets 60, 62, the gaskets 60, 62 are then deformed accordingly. Specifically, the outer of gasket 60 is deformed to an oval shape. The inner gasket 62, which abuts all three of the elements involved in the joint, i.e. the paper-feed housing 12, the rim 40, and the midsection 14, is deformed into an essentially heart-shaped cross section.

Figure 5:
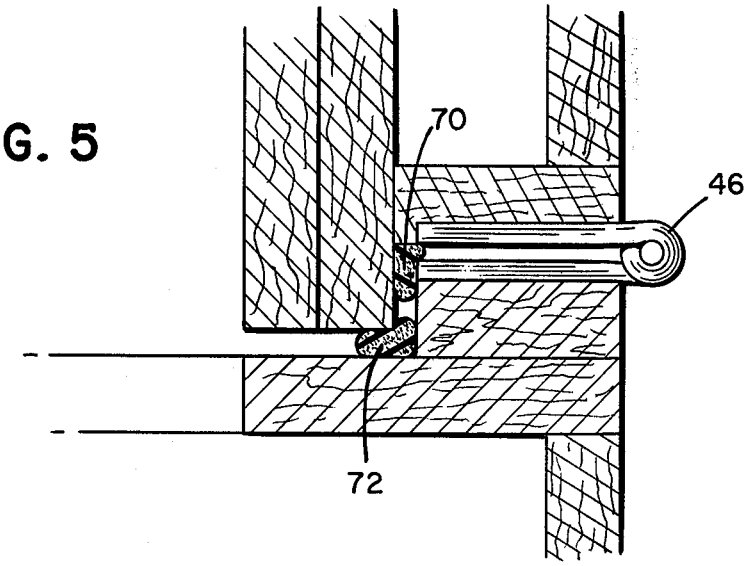
FIG. 5 is a cross-sectional detail of a portion of the inventive acoustical enclosure showing the double gasketing.

FIG. 5 is another cross-sectional view showing the inventive dual gasketing system, and this particular cross section is at the rear of the acoustical enclosure in the vicinity of the hinge 46 between the midsection 14 and the base section 16. As indicated, the hinge 46 serves to attach these two housing elements. Two rubber gaskets 70, 72 are provided and, due to the interaction of the two hinged elements, the rubber gaskets 70, 72 are deformed into a heart shape or cardioid cross section by the action of the edges of the elements, 14 and 16. Such deformation indicates that a seal is formed and, hence, the dual gaskets serve to effectively eliminate transmission of all acoustic waves through the joints of the inventive acoustic enclosure 10.

Figure 6:
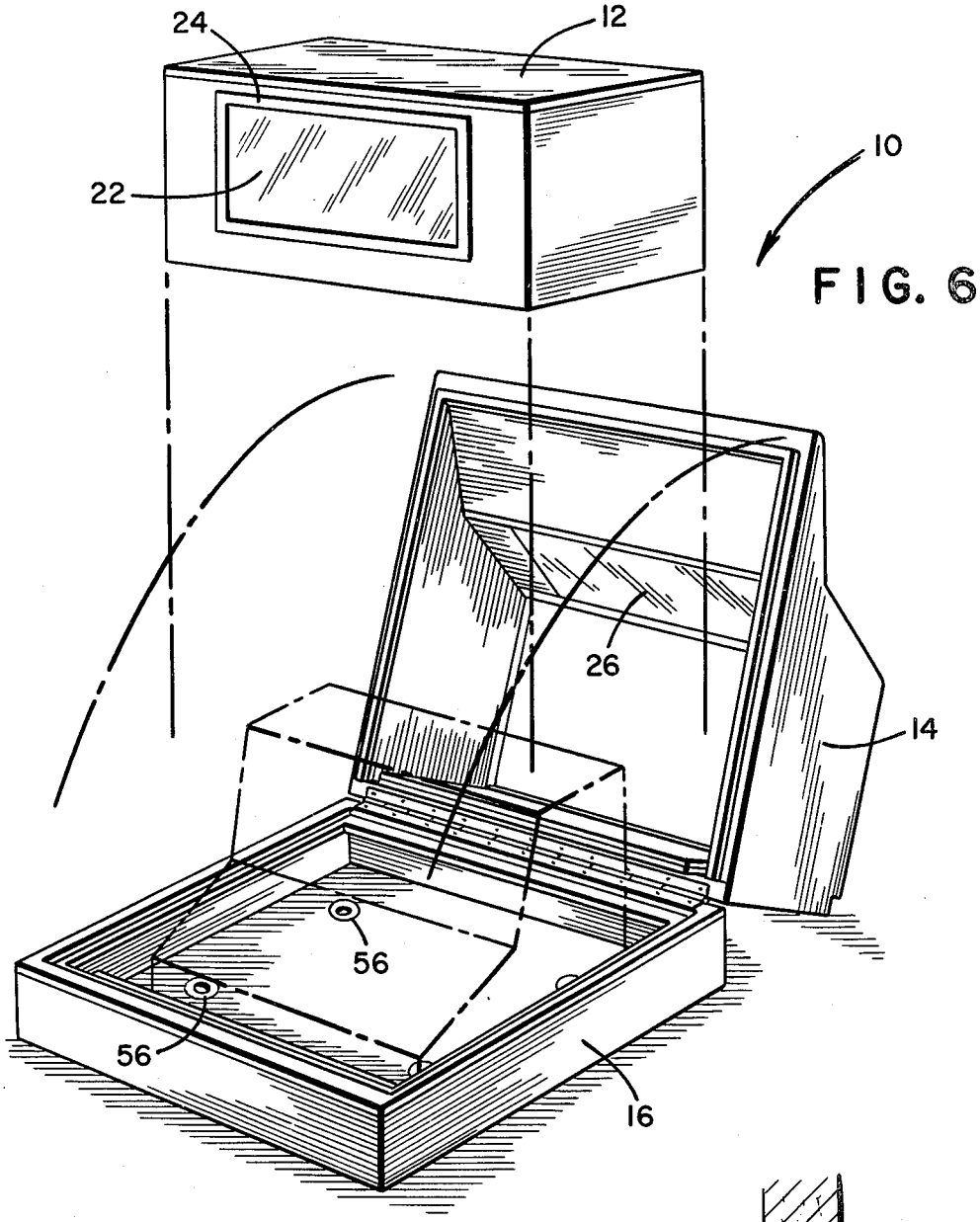
FIG. 6 is an exploded perspective of the inventive acoustical enclosure.

FIG. 6 is an exploded perspective view of the inventive acoustic enclosure 10 showing the paper-feed housing 12 raised above the lower portions of the enclosure. The midsection 14 has been tilted back on its hinge 46 to reveal the business machine 42, in phantom arranged in the bottom portion 16. As may be seen, in this manner the paper-feed housing 12 is simply lifted off and the midsection 14 tilted back, to easily gain access to the automatic business machine 42. Rubber vibration isolating washers, shown typically at 56, are inset into the bottom panel and are arranged to cooperate with the feet of the business machine being enclosed.

The above-detailed description of the present invention is presented by way of example only and is not intended to limit the scope of the invention except as set forth in the claims appended hereto.

What is claimed is:

1. An enclosure for acoustically isolating an automatically operated machine, said enclosure comprising:

a base portion having an open top and a partial bottom panel upon which said machine rests and having an air-intake opening at the bottom of said base portion, a midsection portion having an open top and bottom and being hingedly attached at one edge to said base portion and being formed to circumferentially conform with the top edge of said base portion, a top portion having a closed top and and open bottom and being formed so that the bottom edges circumferentially conform with the top edges of said midsection portion, first and second strips of gasket material arranged between the lower edges of said midsection portion and the upper edges of said base portion, third and fourth strips of gasket material arranged between the upper edges of said midsection portion and the lower edges of said top portion, and exhaust fan means mounted on said midsection portion for drawing air into the air-intake opening in said base portion, past the machine and exhausting the air from the enclosure, whereby said first and second strips of gasket material and said base portion and said midsection portion and said third and fourth strips of gasket material and said mid-section portion and said top portion cooperate, respectively, to contain acoustical noise produced by the machine within the enclosure.

2. The enclosure of claim 1 further comprising at least one clear plastic window located in said midsection portion for permitting the machine to be viewed.

3. The enclosure of claim 1 further comprising at least one clear plastic window located in the top portion for viewing the interior of the enclosure.

4. The enclosure of claim 1 wherein said first, second, third, and fourth strips of gasket material have a substantially circular cross section in a relaxed state.

5. The enclosure of claim 1 further comprising an upstanding inner rim formed around the top edges of said midsection portion and wherein said fourth strip of gasket material is in contact with said rim, the upper edge of said midsection portion and the lower edge of said top portion when said top portion is arranged on said midsection portion.

6. Apparatus for acoustically enclosing an automatic machine, said apparatus comprising:

a base portion having an open top, a bottom panel for supporting said machine, and an air inlet baffle located in the bottom surface;

a midsection portion having an open top and bottom and arranged on top of said base portion;

a top portion having a closed top and an open bottom and arranged on top of said midsection portion;

hinge means affixed to the rear of said midsection portion and the rear of said base portion for hingedly connecting said midsection portion and said base portion;

exhaust fan means mounted on said midsection portion and communicating with the interior of said enclosure for exhausting air contained therein; and double-gasketing means arranged between said base portion and midsection portion and between said midsection portion and said top portion for accoustically sealing said top portion, said midsection portion, and said base portion, one to another such that an acoustically sealed enclosure is formed.

7. The apparatus of claim 6 wherein a clear-plastic window is formed in said midsection portion.

8. The apparatus of claim 6 wherein a clear-plastic window is formed in said top portion.

9. The apparatus of claim 6 wherein vibration-isolating mounting feet are affixed to said bottom panel.

10. The apparatus of claim 6 further comprising a raised metal rim affixed to the top edge of said midsection portion for aligning said top portion on said midsection portion.

* * * * *